US005259275A

United States Patent [19]

Schulze-Beckinghausen

[11] Patent Number: 5,259,275

[45] **Date of Patent: * Nov. 9, 1993**

[54] APPARATUS FOR CONNECTING AND DISCONNECTING THREADED MEMBERS

[75] Inventor: Joerg-Erich Schulze-Beckinghausen, Garbsen, Fed. Rep. of Germany

[73] Assignee: Weatherford/Lamb, Inc., Tex.

[ * ] Notice: The portion of the term of this patent subsequent to Jan. 21, 2009 has been disclaimed.

[21] Appl. No.: 949,410

[22] Filed: Sep. 22, 1992

[30] Foreign Application Priority Data

Jun. 16, 1992 [GB] United Kingdom ..... 9212723

[51] Int. Cl.[5] ..... B25B 17/00

[52] U.S. Cl. ..... 81/57.16; 81/57.34

[58] Field of Search ..... 81/57.16, 57.24, 57.34, 81/57.35, 57.36

[56] References Cited

U.S. PATENT DOCUMENTS

| | | | |
|---|---|---|---|
| 1,386,345 | 8/1921 | McGowan et al. | 81/57.16 |
| 2,668,669 | 2/1954 | Cormany | 81/57.18 |
| 2,737,839 | 3/1956 | Paget | 81/57.34 |
| 2,871,743 | 2/1959 | Kelley | 81/57.2 |
| 3,288,000 | 11/1966 | Foster . | |
| 3,380,323 | 4/1968 | Campbell . | |
| 3,516,308 | 6/1970 | Ham et al. | 81/57.16 |
| 3,722,331 | 3/1973 | Radulescu | 81/52.4 |
| 3,760,658 | 9/1973 | Guier | 81/57.33 |
| 3,838,613 | 10/1974 | Wilms | 81/57.15 |
| 4,041,000 | 8/1983 | Kinzbach | 81/57.2 |
| 4,061,194 | 12/1977 | McCanse | 91/170 R |
| 4,082,017 | 4/1978 | Eckel | 81/57.16 |
| 4,170,908 | 10/1979 | Peveto et al. | 81/57.34 X |
| 4,246,809 | 1/1981 | Keast et al. | 81/57.16 |
| 4,402,239 | 9/1983 | Mooney | 81/57.16 |
| 4,423,647 | 1/1984 | Toelke | 81/57.16 |
| 4,492,134 | 1/1985 | Reinholdt | 81/57.34 |
| 4,494,425 | 1/1985 | Shewmake. Sr. | 81/57.34 |
| 4,574,664 | 3/1986 | Curry | 81/57.34 |
| 4,619,159 | 10/1986 | Kurek | 81/57.34 |
| 4,972,741 | 11/1990 | Sibille | 81/57.16 R |
| 5,081,888 | 1/1992 | Schulze-Beckinghausen | 81/57.16 |
| 5,099,725 | 3/1992 | Bouligny et al. | 81/57.34 |

FOREIGN PATENT DOCUMENTS

| | | |
|---|---|---|
| 2511353 | 4/1975 | Fed. Rep. of Germany . |
| 804798 | 5/1954 | United Kingdom . |
| 1215967 | 11/1968 | United Kingdom . |
| 398987 | 10/1978 | United Kingdom . |
| 2049517A | 4/1979 | United Kingdom . |

OTHER PUBLICATIONS

"General Services And Products Catalog 1990–91" Weatherford, 1989, particularly pp. 13, 27.

"Integral Back Up Tongs," Weatherford, Feb. 1985.

"Well Completion Component Test Facilities," Ksepl, 1986, pp. 12, 13.

"Varco Oil Tools," Composite Catalog, 1982–83, pp. 8378–8382.

"Joy Petroleum Equipment Group," Composite Catalog, 1982–83 pp. 5082–5083.

"Eckel Tongs Back Up Units," Composite Catalog, 1982–83, p. 953.

"Hydraulic Back Up Tongs," Weatherford, prior to 1991.

"1988 Annual Report," Weatherford, 1988, p. 1.

"General Services And Products Catalog," Weatherford 1988–89, pp. 26–28.

"Model 5.5–15 Hydraulic Tubing Tong," Weatherford, 1990.

*Primary Examiner*—James G. Smith

*Attorney, Agent, or Firm*—Guy McClung

[57] ABSTRACT

WO 90/06418 discloses a dynamic torque transmitting arrangement which inhibits a power tong and a back-up tong tending to move out of axial alignment whilst coupling or uncoupling adjacent pipes. In the mechanical arrangement disclosed the minimum distance between the power tong and the back-up tong is limited by a strap. In the present invention flanges are mounted on opposite sides of the top of the power tong. Tension arms are pivotally mounted on the flanges and are connected by a hollow tube. Straps are pivotally mounted at one end to the tension arms and at the other end to hollow pillars on which the back-up tong is slideably mounted. When the power tong and the back-up tong are in close proximity the straps are disposed to either side of the power tong. The back-up tong is supported from the power tong by rods which are connected to plates on which the hollow pillars rest.

8 Claims, 2 Drawing Sheets

APPARATUS FOR CONNECTING AND DISCONNECTING THREADED MEMBERS

FIELD OF THE INVENTION

This invention relates to an apparatus for connecting and disconnecting threaded members.

BACKGROUND OF THE INVENTION

In our PCT patent application PCT/EP89/01437 (Publication No. WO 90/06418) we describe an apparatus for connecting and disconnecting threaded members, which apparatus comprises a power tong having a pipe receiving recess and a jaw assembly for gripping and rotating a first pipe, a back-up unit having a pipe receiving recess and means for gripping a second pipe, and means for transmitting reaction forces generated by said power tong to said back-up unit, which means comprises:

a first member connected to one of said power tong and said back-up unit remote from the pipe receiving recess thereof and to the other of said power tong and said back-up unit to one side of the pipe receiving recess thereof; and a second member connected to said one of said power tong and said back-up unit remote from the pipe receiving recess thereof and to said other of said power tong and said back-up unit to the other side of the pipe receiving means thereof, wherein said apparatus comprises dynamic means for transmitting compressive and/or tensile forces in one of said first and second members to the other of said first and second members.

In the embodiments described in FIGS. 2 and 3 of said PCT patent application, said first member and said second member each comprise straps and said means for transmitting compressive and/or tensile forces in one of said first and second members comprises a third member (a tube) mounted for pivotal movement on one of said power tong and said back-up unit about an axis extending between said first member and said second member, said third member having a first tension arm and a second tension arm extending away from said axis, said first member being pivotally connected to said first tension arm and said second member being pivotally connected to said second tension arm.

Whilst the arrangement shown works admirably for most purposes it has the limitation that the power tong and the back-up unit cannot be moved close together.

SUMMARY OF THE PRESENT INVENTION

In the present invention said first member and second member each comprise straps, wherein a first tension arm is pivotally mounted to one side of one of said power tong and said back-up tong, wherein a second tension arm is pivotally mounted to the other side of said one of said power tong and said back-up tong, wherein said first tension arm and said second tension arm are connected by a third member, and wherein said first member is pivotally mounted to said first tension arm and said second member is pivotally mounted to said second tension arm, so that when said back-up tong and said power tong are in close proximity at least part of said first and second members lie to either side of one of said power tong and said back-up tong.

Preferably, said first member is pivotally mounted to said first tension arm between the pivotal mounting of said first tension arm to said one of said power tong and said back-up tong and said third member, and said second member is pivotally mounted to said second tension arm between the pivotal mounting of said second tension arm to said one of said power tong and said back-up tong and said third member.

In one embodiment of the invention one of said power tong and said back-up tong includes flanges which extend away from the other of said power tong and said back-up tong, and said first tension arm and said second tension arm are pivotally mounted to said flanges.

In order to allow said back-up tong limited movement with respect to said power tong said power tong is preferably provided with a support rod provided with a support plate on which a hollow pillar rests and on which hollow pillar said back-up tong is slideably mounted.

Advantageously, a coil spring is provided which at least partially supports said back-up tong.

For a better understanding of the present invention reference will now be made, by way of example, to the accompanying drawings, in which:-

DESCRIPTION OF THE PREFERRED EMBODIMENT

Figure 1:
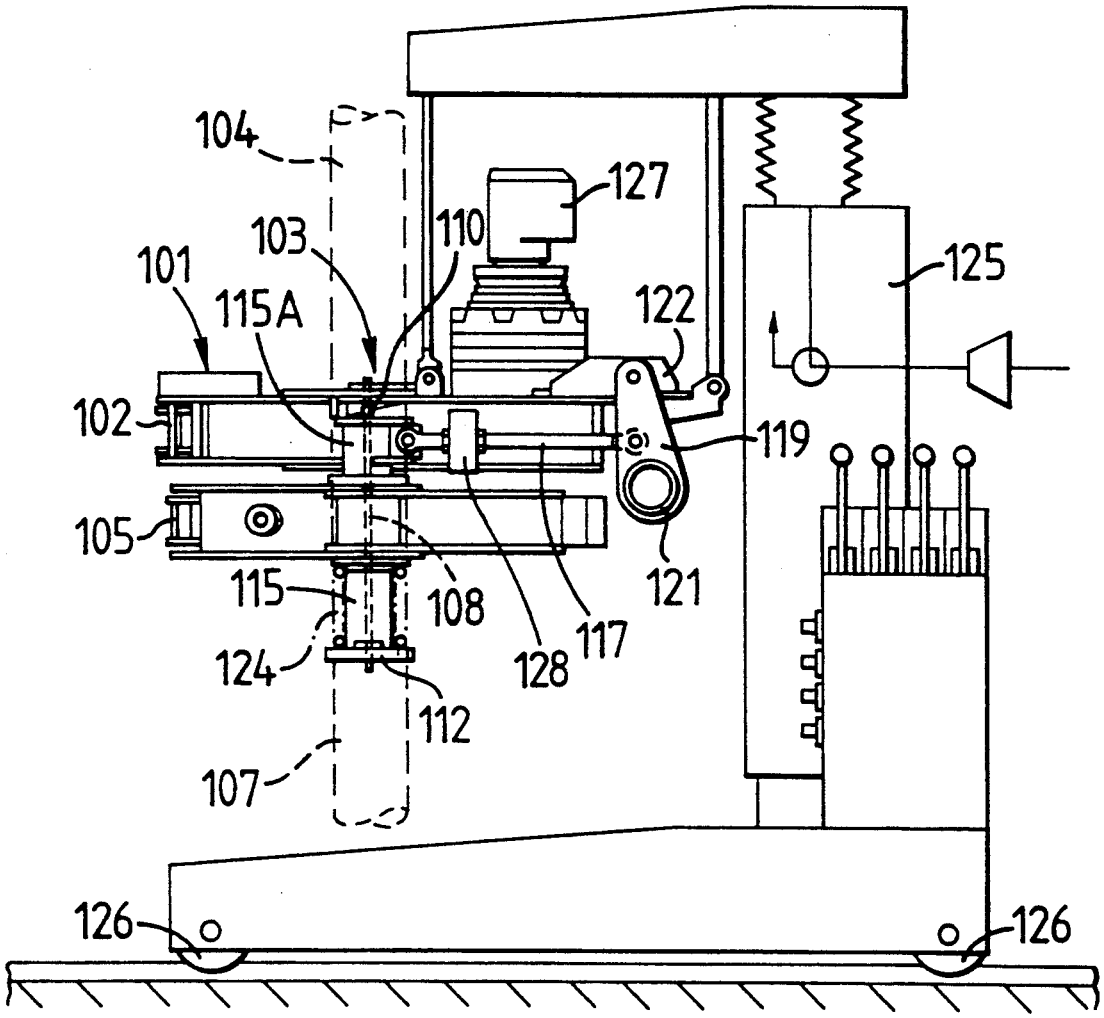
FIG. 1 shows one side view of one embodiment of an apparatus in accordance with the invention.

Referring drawings, there is shown an apparatus which is generally identified by reference numeral 101. The apparatus 101 comprises a power tong 102 which has a pipe receiving recess 103.

A back-up unit 105 is disposed below the power tong 102 and is slideably mounted on two pillars 115 and 116 which are situated on diametrically opposite sides of pipe receiving recess 106 and equidistant from the centre thereof. The pillars 115, 116 are hollow and rest on plates 112, 113 suspended from the power tong 102 via rods 108, one on either side of the apparatus (one shown in FIG. 1). The upper end of each rod 108 has an eye 110 which is pivotally mounted on a bolt attached to the power tong 102. The pillars 115, 116 simply rest on the plates so that the back-up tong 105 is free for limited movement in a horizontal plane with respect to the power tong 102. A fitting 115A is welded to the upper end of the pillar 115 whilst a similar fitting 116B is welded to the upper end of pillar 116.

One end of a strap 117 is pivotally attached to pillar 115 whilst the other end is pivotally mounted to a tension arm 119. Similarly, one end of a strap 118 is pivotally mounted to a tension arm 120. The lower ends of tension arms 119 and 120 are rigidly connected to a hollow tube 121 of circular cross-section whilst the upper ends are pivotally mounted on flanges 122, 123 respectively which are mounted on the top of the power tong 102.

As shown in the Figures, the back-up tong 105 is biased into its uppermost position in preparation for an uncoupling operation by a springs which act between the plates 112, 113 and the bottom of the back-up unit 105. One such spring 124 is shown in FIG. 1.

In order to uncouple a threaded joint between an upper pipe 104 and a lower pipe 107 a frame 125 having wheels 126 is advanced towards the pipes 104, 107 with the gates on the power tong 102, and the back-up unit 105 open.

Once the pipes 104, 107 are received in the power tong 102 and the back-up tong 105 the respective gates are closed with the lower pipe 107 firmly held in the back-up tong 105.

Hydraulic fluid is then pumped to hydraulic motor 127 on the power tong 102. This causes the jaws of the power tong 102 to advance, grip the pipe 104 and rotate it to unscrew the joint.

The torque applied to pipe 104 creates a reaction force which, because of the straps 117, 118, tension arms 119 and 120, and the hollow tube 121 results in substantially equal and opposite turning moments being applied to back-up unit 105. This inhibits the tendency of pipe receiving recess 103 to move out of axial alignment with pipe receiving recess 106 under load and this substantially eliminates the bending of the pipe. The torque applied to the joint is measured by a load cell 128 in the strap 117 and recorded to form part of the history of the pipes.

As the joint is unscrewed pipe 104 rises. Power tong 102 also rises to match this movement and pillar 115 also rises. The back-up tong 105 remains in a fixed position so that the spring 124 is compressed.

Figure 2:
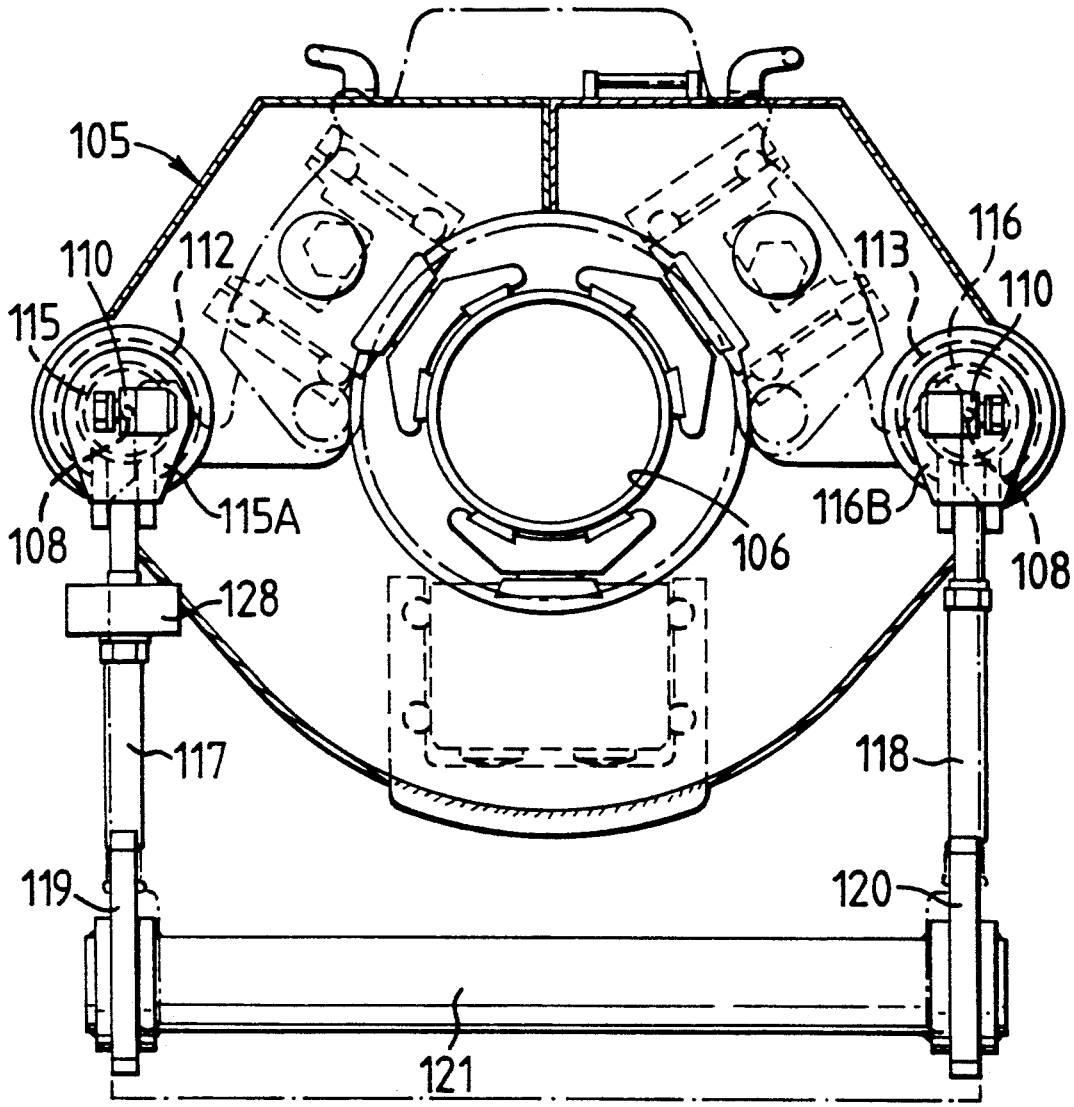
FIG. 2 is a plan view of the apparatus shown in FIG. 1 with the power tong omitted for clarity.

It will be noted that in the position shown in the FIGS. 1 and 2 and back-up tong 105 is in close proximity to the power tong 102 and that the straps 117 and 118 are disposed to either side of the power tong 102. It will be noted that such close proximity cannot be achieved with the embodiment shown in FIGS. 2 and 3 of our PCT/EP/89/01437 where the straps are disposed between the power tong and the back-up tong.

Various modifications to the embodiment described are envisaged, for example the hollow tube 121 could be replaced by a solid rod or hollow tube of any desired cross-section. Furthermore, the hollow tube 121 could extend between the tension arms 119, 120 at any position thereon including acting as a pivot pin on the flanges 122, 123 and in line with the pivot mounting of the straps 117, 118 on their respective tension arms 119, 120. If desired, the torque transmitting arrangement could be reversed, i.e., the flanges 122 and 123 could extend downwardly from the back-up tong 105. In such an embodiment the tension arms 119 and 120 would extend upwardly and their upper extremities would be connected by a hollow tube 121. Straps 117 would be pivotally mounted at one end to the tension arms 119, 120 between the hollow tube 121 and the pivot point on the flanges 122 and 123 and the other end of the tension arms 119 and 120 would be pivotally mounted on pillars 115, 116 slideably supporting the power tong 102.

We claim:

1. An apparatus for connecting and disconnecting threaded members, which apparatus comprises a power tong having a pipe receiving recess and a jaw assembly for gripping and rotating a first pipe, a back-up unit for gripping a second pipe, and means for transmitting reaction forces generated by said power tong to said back-up unit, which means comprises a first member connected to one of said power tong and said back-up unit remote from the pipe receiving recess thereof and to the other of said power tong and said back-up unit to one side of the pipe receiving recess thereof; and a second member connected to said one of said power tong and said back-up unit remote from the pipe receiving recess thereof and to said other of said power tong and said back-up unit to the other side of the pipe receiving recess thereof;

wherein said first member and second member each comprise straps, wherein a first tension arm is pivotally mounted to one side of one of one of said power tong and said back-up tong, wherein a second tension arm is pivotally mounted to the other side of said one of said power tong and said back-up tong, wherein said first tension arm and said second tension arm are connected by a third member, and wherein said first member is pivotally mounted to said first tension arm and said second member is pivotally mounted to said second tension arm, so that when said back-up tong and said power tong are in close proximity at least part of said first and second members lie to either side of said one of said power tong and said back-up tong; and said power tong provided with a support rod provided with a support plate on which a hollow pillar rests and on which hollow pillar said back-up tong is slideably mounted.

2. An apparatus as claimed in claim 1, including a coil spring which at least partially supports said back-up tong.

3. An apparatus for connecting and disconnecting threaded members, which apparatus comprises a power tong having a pipe receiving recess and a jaw assembly for gripping and rotating a first pipe, a back-up unit for gripping a second pipe, and means for transmitting reaction forces generated by said power tong to said back-up unit, which means comprises a first member connected to one of said power tong and said back-up unit remote from the pipe receiving recess thereof and to the other of said power tong and said back-up unit to one side of the pipe receiving recess thereof; and a second member connected to said one of said power tong and said back-up unit remote from the pipe receiving recess thereof and to said other of said power tong and said back-up unit to the other side of the pipe receiving recess thereof;

wherein said first member and second member each comprise straps, wherein a first tension arm is pivotally mounted to one side of one of one of said power tong and said back-up tong, wherein a second tension arm is pivotally mounted to the other side of said one of said power tong and said back-up tong, wherein said first tension arm and said second tension arm are connected by a third member, and wherein said first member is pivotally mounted to said first tension arm and said second member is pivotally mounted to said second tension arm, so that when said back-up tong and said power tong are in close proximity at least part of said first and second members lie to either side of said one of said power tong and said back-up tong; and wherein said first member is pivotally mounted to said first tension arm between the pivotal mounting of said first tension arm to said one of said power tong and said back-up tong and said third member, and said second member is pivotally mounted to said second tension arm between the pivotal mounting of said second tension are to said one of said power tong and said back-up tong and said third member.

4. An apparatus as claimed in claim 3, wherein said power tong is provided with a support rod provided with a support plate on which a hollow pillar rests and on which hollow pillar said back-up tong is slideably mounted.

5. An apparatus as claimed in claim 4, including a coil spring which at least partially supports said back-up tong.

6. An apparatus for connecting and disconnecting threaded members, which apparatus comprises a power tong having a pipe receiving recess and a jaw assembly for gripping and rotating a first pipe, a back-up unit for gripping a second pipe, and means for transmitting reaction forces generated by said power tong to said back-up unit, which means comprises a first member connected to one of said power tong and said back-up unit remote from the pipe receiving recess thereof and to the other of said power tong and said back-up unit to one side of the pipe receiving recess thereof; and a second member connected to said one of said power tong and said back-up unit remote from the pipe receiving recess thereof and to said other of said power tong and said back-up unit to the other side of the pipe receiving recess thereof;

wherein said first member and second member each comprise straps, wherein a first tension arm is pivotally mounted to one side of one of one of said power tong and said back-up tong, wherein a second tension arm is pivotally mounted to the other side of said one of said power tong and said back-up tong, wherein said first tension arm and said second tension arm are connected by a third member, and wherein said first member is pivotally mounted to said first tension arm and said second member is pivotally mounted to said second tension arm, so that when said back-up tong and said power tong are in close proximity at least part of said first and second members lie to either side of said one of said power tong and said back-up tong;

wherein said first member is pivotally mounted to said first tension arm between the pivotal mounting of said first tension arm to said one of said power tong and said back-up tong and said third member, and said second member is pivotally mounted to said second tension arm between the pivotal mounting of said second tension arm to said one of said power tong and said back-up tong and said third member; and wherein one of said power tong and said back-up tong includes flanges which extend away from the other of said power tong and said back-up tong, and said first tension arm and said second tension arm are pivotally mounted to said flanges.

7. An apparatus as claimed in claim 6, wherein said power tong is provided with a support rod provided with a support plate on which a hollow pillar rests and on which hollow pillar said back-up tong is slideably mounted.

8. An apparatus as claimed in claim 7, including a coil spring which at least partially supports said back-up tong.

* * * * *